US010753619B2

(12) United States Patent
Yang

(10) Patent No.: US 10,753,619 B2
(45) Date of Patent: Aug. 25, 2020

(54) KNOB STRUCTURE FOR ELECTROMAGNETIC OVEN

(71) Applicant: SHANGHAI CHUNMI ELECTRONICS TECHNOLOGY CO., LTD., Shanghai (CN)

(72) Inventor: Hua Yang, Shanghai (CN)

(73) Assignee: SHANGHAI CHUNMI ELECTRONICS TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/348,027

(22) PCT Filed: Apr. 10, 2018

(86) PCT No.: PCT/CN2018/082449
§ 371 (c)(1),
(2) Date: May 7, 2019

(87) PCT Pub. No.: WO2018/188574
PCT Pub. Date: Oct. 18, 2018

(65) Prior Publication Data

US 2019/0301744 A1 Oct. 3, 2019

(30) Foreign Application Priority Data

Apr. 12, 2017 (CN) ..... 2017 2 0378812 U

(51) Int. Cl.
*D06F 34/30* (2020.01)
*F24C 3/12* (2006.01)
(Continued)

(52) U.S. Cl.
CPC ..... *F24C 7/082* (2013.01); *D06F 34/30* (2020.02); *F24C 3/122* (2013.01); *F24C 3/124* (2013.01);
(Continued)

(58) Field of Classification Search
CPC .... H01H 2221/01; H01H 19/00; H01H 19/02; H01H 19/025; H01H 19/14; H01H 19/06;
(Continued)

(56) References Cited

U.S. PATENT DOCUMENTS 9,006,591 B2 * 4/2015 Williamson ..... H01H 19/02 200/11 R
9,941,078 B2 * 4/2018 Lyszus ..... H03K 17/9622
(Continued)

*Primary Examiner* — Vanessa Girardi

(57) ABSTRACT

A knob structure for an electromagnetic oven includes a knob switch assembly. The knob switch assembly consists of a sleeve button, a rotary encoder, a bracket of a display screen, and a control assembly. The knob switch assembly is connected to a printed circuit board through a through hole. A guide rib is disposed around a circumference of the through hole. The display screen with a protection assembly disposed outside is integrated with the knob switch assembly. The guide rib effectively prevents water from entering inside of the electromagnetic oven, lengthens a service life of the electromagnetic oven, and facilitates cleaning. The knob switch assembly integrated with the display screen realizes miniaturization and reduces a cost. The protection assembly ensures a display effect of the display screen.

19 Claims, 14 Drawing Sheets

(51) Int. Cl.

| | |
|---|---|
| ***F24C 7/08*** | (2006.01) |
| ***H01H 19/14*** | (2006.01) |
| ***H05B 6/12*** | (2006.01) |
| ***F24C 15/00*** | (2006.01) |
| ***F24C 15/14*** | (2006.01) |
| ***F24C 7/00*** | (2006.01) |

(52) U.S. Cl.
CPC ..... *F24C 7/00* (2013.01); *F24C 7/08* (2013.01); *F24C 15/00* (2013.01); *F24C 15/14* (2013.01); *H01H 19/14* (2013.01); *H05B 6/12* (2013.01); *F24C 7/002* (2013.01); *H01H 2231/012* (2013.01)

(58) Field of Classification Search
CPC ..... H01H 19/585; H01H 2043/107; H01H 2223/01; H01H 2223/012; H01H 2223/018; H01H 2231/012; D06F 34/28; D06F 34/30; D06F 34/00; G05B 2219/23048; F24C 3/12; F24C 3/124; F24C 3/122; F24C 7/08; F24C 15/14
See application file for complete search history.

(56) References Cited

U.S. PATENT DOCUMENTS 10,275,052 B2 * 4/2019 Kang ..... G06F 3/02
10,465,331 B2 * 11/2019 De Pellegrin ..... D06F 58/30

* cited by examiner

KNOB STRUCTURE FOR ELECTROMAGNETIC OVEN

CROSS REFERENCE OF RELATED APPLICATION

This is a U.S. National Stage under 35 U.S.C 371 of the International Application PCT/CN2018/082449, filed Apr. 10, 2018, which claims priority under 35 U.S.C. 119(a-d) to CN 201720378812.9, filed Apr. 12, 2017.

BACKGROUND OF THE PRESENT INVENTION

Field of Invention

The present invention relates to the field of configuration of a control device for a stove or an oven heated with electric energy, and in particular relates to a knob structure for an electromagnetic oven.

Description of Related Arts

An electromagnetic oven, also known as an electromagnetic stove, by using an alternating current through the coil, generates an alternating magnetic field with a direction constantly changing. A vortex current will appear inside a conductor in the alternating magnetic field, and through the Joule heating effect of the vortex current, the conductor is heated up, thereby achieving a heating function.

The electromagnetic oven generally includes the following components: a panel for supporting a cookware, a high-voltage main substrate constituting a main current loop, a low-voltage main substrate for computer control, a LED (Light-Emitting Diode) circuit board for displaying operation states and delivering operation instructions, a coil disk for converting a high frequency alternating current into an alternating magnetic field, an IGBT (Insulated Gate Bipolar Transistor) for controlling switching on and off of a large current with a low-current signal, a bridge rectifier that converts an alternating current power source into a direct current power source, and a control assembly that adjusts the power of the electromagnetic oven.

In view of the above principle of the electromagnetic oven, as well as many advantages of the electromagnetic oven, such as high heating speed, energy saving, environmental protection, easy cleaning, and precise temperature control, the electromagnetic oven has gained tremendous popularity.

During the operation of the electromagnetic oven, the power of the electromagnetic oven is generally adjusted via the power control assembly. At present, the control methods of the electromagnetic ovens, which are available on the market, are mostly implemented via buttons of two types, respectively a touch button and a mechanical button. The product with a touch button often fails in operation, because the operating part is stuck with something such as soup or water so that the operation signal cannot be accepted by the main control chip. The mechanical buttons often tend to be broken or fail, due to mechanical fatigue and oil corrosion of the PET (Polyethylene Terephthalate) elastic bulging provided on the panel during long-term operation.

However, if the button operation is replaced by knob operation mode with the built-in rotary encoder, new problems will arise that: since the knob is protruding, it becomes more difficult for the user to clean the oven because of the protruding knob structure, and it requires higher costs since the operation display interface is larger.

In addition, if the button operation is replaced by knob operation mode with the built-in rotary encoder, a through hole for the knob switch is required to be provided on the casing of the electromagnetic oven. In order to realize the rotation operation, a gap is provided between the inner wall of the through hole and the outer wall of the knob switch. For the electromagnetic oven, if soup or oil in the cooking process flows into the casing along the circumferential gap of the knob switch, it may easily cause a short circuit or other malfunction inside the casing.

With the advancement of technology, smart cooking appliances have gradually entered the daily life of people, and they are getting more and more popular because of the simple operation of smart cooking appliances, rich preset contents, intelligent cooking, simple and beautiful appearance, and efficient acquisition of the cooking time and the cooking states. Electromagnetic ovens, as representative cooking appliance products, have begun to gradually utilize OLED (Organic Light-Emitting Diode) devices as product function display units, reflecting the high-tech level of the products. In order to achieve the consistency of the OLED screen and the appearance of the product and to protect the OLED screen, generally in the industry, a transparent shield is provided on the OLED screen. The shield and the non-display area of the OLED screen are sprayed or pasted with non-transparent paint or film to shield the unexposed area inside the screen, so as to improve the appearance and grade of the product. However, both of the partial spraying and the partial pasting processes require relatively high precision in processing technology and result high costs.

SUMMARY OF THE PRESENT INVENTION

An object of the present invention is to provide an electromagnetic oven, so as to solve problems in the prior art.

Technical solutions of the present invention are described as follows.

A knob structure for an electromagnetic oven includes at least one knob switch assembly disposed on a casing and a printed circuit board disposed in the casing, wherein: the knob switch assembly is connected to the printed circuit board through a through hole provided on the casing;

a guide rib protruding from the casing is disposed around a circumference of the through hole;

a display screen is equipped on the knob switch assembly;

a protection assembly is provided outside the display screen; and the knob switch assembly includes a sleeve button, a rotary encoder, a bracket of the display screen, and a control assembly.

The sleeve button, the rotary encoder and the bracket of the display screen are sequentially assembled along an axis from outside to inside.

The sleeve button is provided with a limit structure thereon for preventing a relative circumferential rotation between the sleeve button and the rotary encoder; the limit structure includes a plurality of buckles disposed at a first end of the sleeve button, adjacent to the printed circuit board, and a plurality of raised ribs disposed on an inner wall of the sleeve button.

An inner flange is provided on an inner wall of a second end of the sleeve button, wherein the second end of the sleeve button is away from the printed circuit board.

The rotary encoder includes a fixed inner frame and a rotating outer frame having a hollow structure, the fixed inner frame is coaxially sleeved with the rotating outer frame, and one end of the fixed inner frame is fixed to an outer side of the printed circuit board.

At least one outer buckle and at least one outer keyway slot are provided on an outer wall of the rotating outer frame, and at least one inner buckle and one limit slot are provided on an inner wall of the fixed inner frame.

A first end of the bracket of the display screen is inserted into the fixed inner frame, an end surface of a second end of the bracket away from the printed circuit board is provided with a mounting groove, and an outer wall of the bracket of the display screen is provided with at least one limit rib and at least one limit snap.

A plurality of snap holes are formed on an outer side of a groove wall of the mounting groove, a linear hole is provided at a bottom end of the mounting groove, a set of catching ribs are provided on an inner wall of the mounting groove symmetrically, and a bottom rib is formed at a lower side of the inner wall of the mounting groove; a left mounting groove and a right mounting groove are respectively formed at left and right sides of the mounting groove, and a fixing hole is formed in each of the left mounting groove and the right mounting groove.

The control assembly includes a switch button disposed on the outer side of the printed circuit board, a flange piece which is disposed on and parallel to an end surface of the first end of the bracket of the display screen facing the printed circuit board, and at least one elastic element and at least one support rib disposed on the first end of the bracket of the display screen adjacent to the printed circuit board; both ends of the elastic element are respectively connected to the bracket of the display screen, and the support rib is fixed to the elastic element, and supports a surface of the printed circuit board.

The control assembly includes a snap, a lock provided within the electromagnetic oven, a return spring, and an annular rib formed on an inner wall of the bracket of the display screen, wherein: the lock includes a mounting plate and a lock body connected to the mounting plate, the lock body is provided with a lock catch therein, the snap is fixed on an outer side wall of the bracket of the display screen and matched with the lock catch through the through hole of the printed circuit board, one end of the return spring is fixed to a surface of the mounting plate, and the other end of the return spring is fixed to an inner side wall of the bracket of the display screen and is caught by the annular rib.

The control assembly further includes a signal unit, wherein the signal unit includes a signal transmitting unit, a signal receiving unit and a signal shielding unit. When the return spring is in an extended state, the signal shielding unit shields a signal between the signal receiving unit and the signal transmitting unit, so as to input a control signal for adjusting the electromagnetic oven by rotating the knob switch assembly.

The signal unit is a combination of a photoelectric switch and a light shielding sheet, a combination of a magnetic reed switch and a magnet, or a combination of a Hall element and a magnet.

The photoelectric switch or the light shielding sheet is disposed on the outer side of the printed circuit board facing the rotary encoder; and, the light shielding sheet or the photoelectric switch is disposed on the sleeve button.

An outer surface of the guide rib is a concave curved surface, and an inner diameter of the guide rib is gradually reduced from inside to outside.

A tail end of the guide rib is provided with a flange on an upper half or full circle thereof, and the flange protrudes from an outer surface of the tail end of the guide rib.

A height of the flange is ≥1 mm.

The display screen is an OLED (Organic Light-Emitting Diode) screen.

A screen display area is formed in the display screen.

The protection assembly includes a screen shield, a heat welding column is formed on a backside of the screen shield, and an outer side wall of the screen shield is provided with a plurality of buckles that are snapped to snap holes in a one-to-one correspondence; the screen shield is fixed to the bracket of the display screen by heat welding, and a semi-transparent shield display area is formed at an area of the screen shield corresponding to the display screen.

A front surface of the screen shield forms a glossy surface, and a back surface of the screen shield forms a partial-frosted and partial-glossy surface.

The protection assembly further includes a light blocking sheet.

The light blocking sheet is disposed between the screen shield and the display screen, and is directly adhered to or indirectly fixed to the display screen.

A shield transparent area of an opening structure, corresponding to the screen display area, is formed on the light blocking sheet, and at least one limit hole corresponding to the heat welding column is disposed around the shield transparent area.

The beneficial effects of the present invention are as follows.

In the present invention, the knob switch assembly is provided as a telescopic structure and is provided with a signal unit therein. In operation, once pressed, the knob switch assembly will automatically pop up, and the user can adjust the power and the heating time of the electromagnetic oven through the knob switch assembly. After operation, the knob switch assembly will be retracted to the inside of the electromagnetic oven when it is pressed. It can prolong the service life of the electromagnetic oven and facilitate the cleaning by the user.

The present invention integrates three kinds of signal receiving devices and signal feedback devices, respectively the display screen, the rotary encoder and the control assembly, into the knob switch assembly, thereby effectively saving the space of the electromagnetic oven occupied by the operation display interface, miniaturizing the product and lowering the cost.

The present invention adopts a guide rib around the knob switch assembly of the casing, so that when the soup overflowing accidentally from the casing flows downward or along the casing, the soup flowing to a position near the knob switch assembly will be guided by the guide rib and then flow towards a direction of the outer peripheral surface of the guide rib, so as to prevent the soup from flowing into the inside of the casing.

The present invention realizes fixing of the display screen by the mounting groove on the bracket of the display screen, realizes the protection of the display screen by the screen shield and the light blocking sheet, and ensures the display effect of the OLED screen. The present invention can ensure that the display is clear by arranging the display area of the protection assembly to be slightly larger than that of the display screen. The present invention realizes the fixing of the protection assembly and the bracket of the display screen by the heat welding column and the snap hole, and can ensure the stability of the protection assembly.

In figures: 1: casing; 2: coil disk; 3: panel; 4: knob switch assembly; 5: printed circuit board; 6: guide rib; 7: display screen; 8: protection assembly; 11: through hole; 41: sleeve button; 42: rotary encoder; 43: bracket of display screen; 44: control assembly; 411: buckle; 412: raised rib; 413: inner flange; 421: fixed inner frame; 422: rotating outer frame; 4211: inner buckle; 4212: limit slot; 4221: outer buckle; 4222: outer keyway slot; 431: mounting groove; 432 limit rib; 433: limit snap; 434: snap hole; 4311: linear hole; 4312: catching rib; 4313: bottom rip; 4314: left mounting groove; 4315: right mounting groove; 4316: lower mounting groove; 4317: fixing hole; 441*a*: switch button; 442*a*: elastic element; 443*a*: support rib; 444*a*: flange piece; 441*b*: snap; 442*b*: lock; 443*b*: return spring; 444*b*: annular rib; 442*b*1: mounting plate; 442*b*2: lock body; 442*b*3: lock catch; 445*b*: photoelectric switch; 446*b*: light shielding sheet; 61: flange; 71: screen display area; 81: screen shield; 811: heat welding column; 812: buckle; 813: shield display area; 82: light blocking sheet; 821: shield transparent area; 822: limit hole; and 51: through hole.

DETAILED DESCRIPTION OF THE PREFERRED EMBODIMENT

Hereinafter, the present invention will be described in detail with reference to the accompanying drawings and preferred embodiments.

Figure 1:
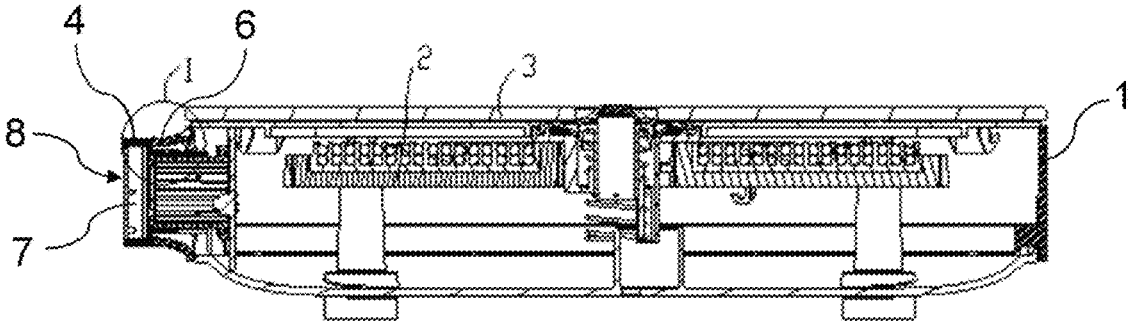
FIG. 1 is a cross-sectional view of an electromagnetic oven according to the present invention.
Figure 2:
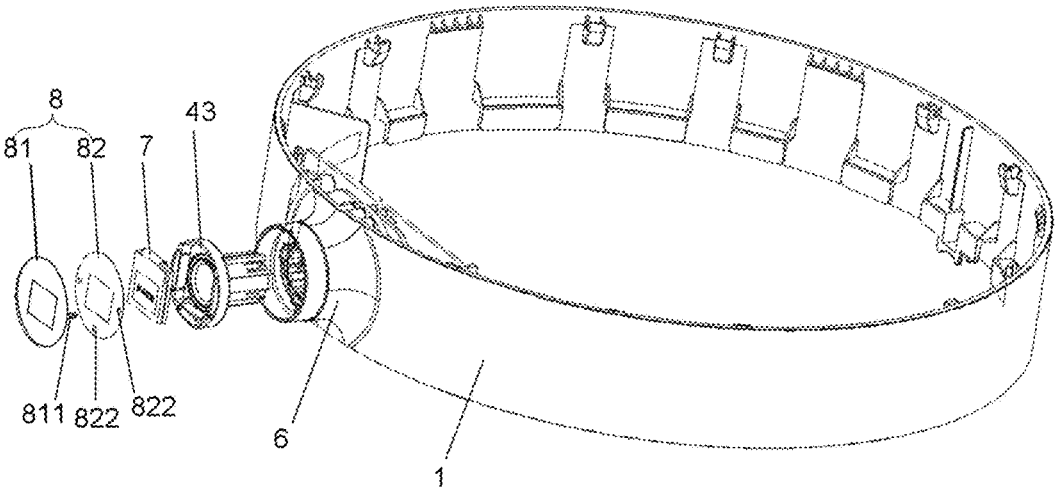
FIG. 2 is a schematic exploded diagram of a knob structure according to the present invention.
Figure 3:
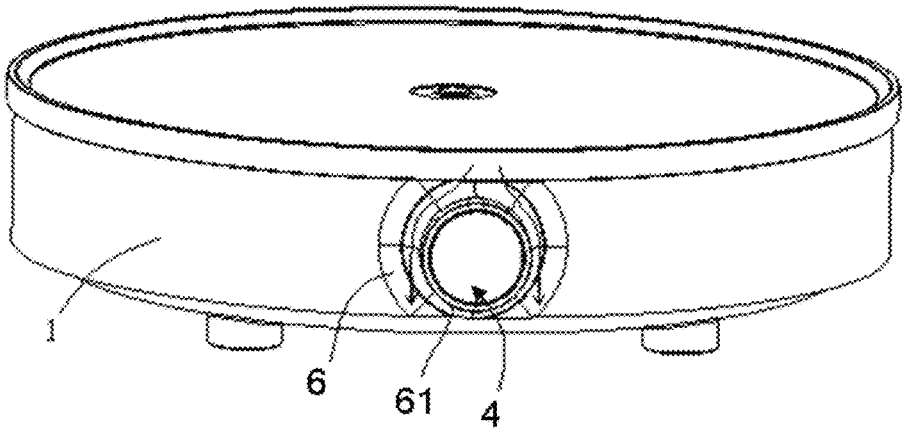
FIG. 3 is an overall structural view of the knob structure according to the present invention.

As shown in FIGS. 1 to 3, an electromagnetic oven includes a casing 1, a coil disk 2 and a panel 3. The casing 1 is provided with at least one knob switch assembly 4. The casing 1 is provided with a printed circuit board 5 therein, and a through hole 11 is formed on the casing 1. The knob switch assembly 4 is connected to the printed circuit board 5 through the through hole 11, and a guide rib 6 protruding from the casing 1 is disposed around a circumference of the through hole 11. The knob switch assembly 4 is equipped with a display screen 7 thereon. A protection assembly 8 is arranged outside the display screen 7. The printed circuit board 5 is a printed circuit board integrated with an MCU (Microcontroller Unit). The knob switch assembly 4 is cylindrical or approximately cylindrical.

Figure 4:
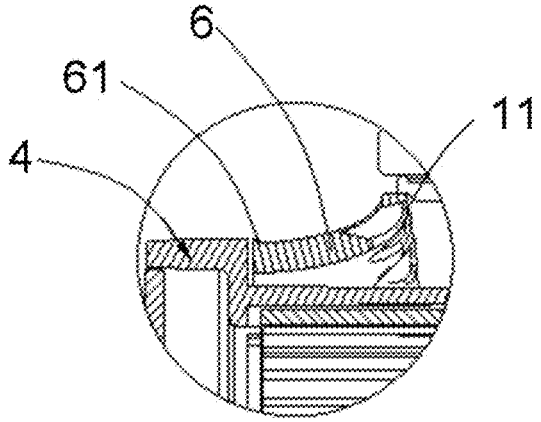
FIG. 4 is an enlarged schematic view of a portion I in FIG. 1.
Figure 5:
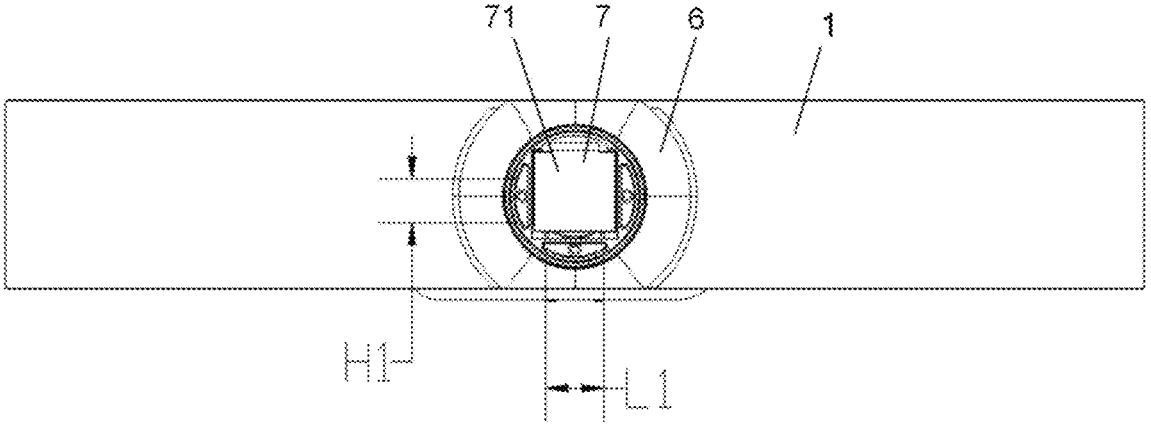
FIG. 5 is a front view of the knob structure without a protection assembly according to the present invention.
Figure 6:
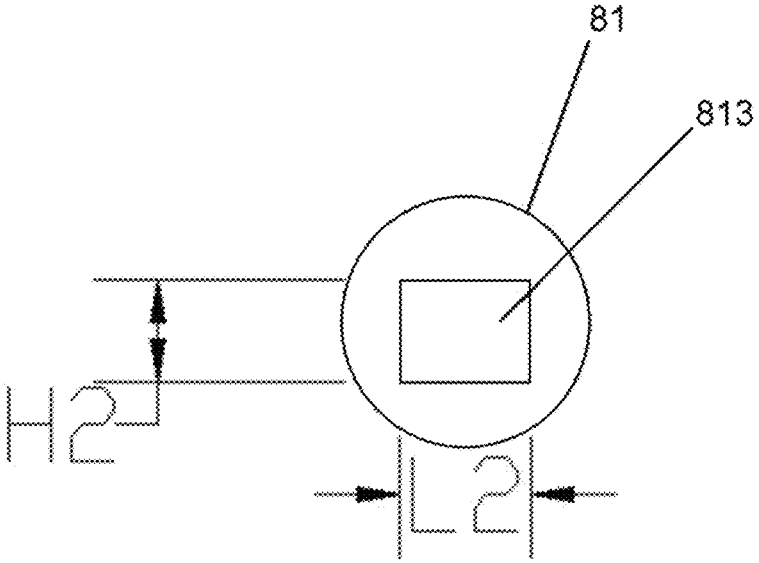
FIG. 6 is a schematic structural diagram of a screen shield according to the present invention.
Figure 7:
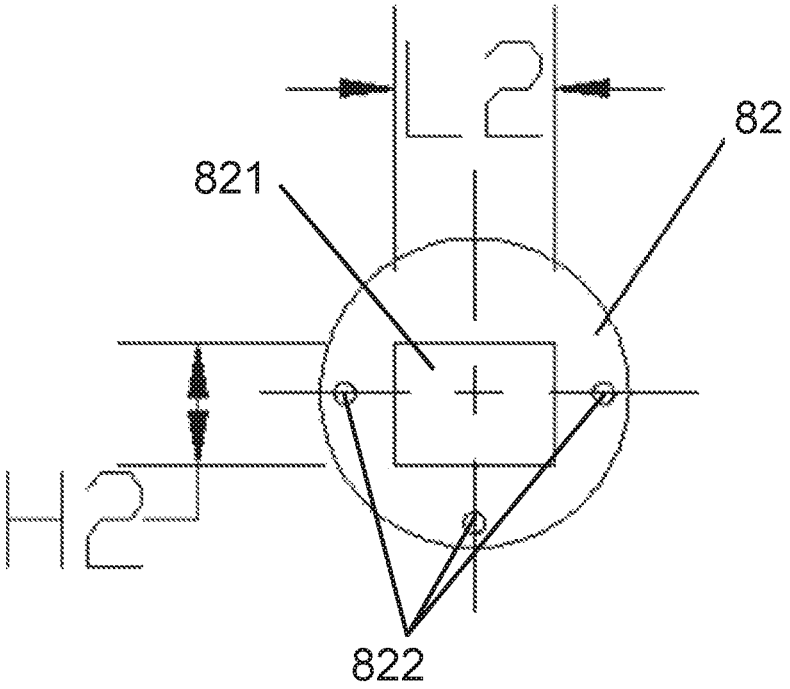
FIG. 7 is a schematic structural diagram of a light blocking sheet according to the present invention.

As shown in FIGS. 3 and 4, an outer surface of the guide rib 6 is a concave curved surface, and an inner diameter of the guide rib 6 is gradually reduced from inside to outside. The guide rib 6 is centered or approximately centered on a center of the to through hole 11. A transitional curved surface between the guide rib 6 and the casing 1 can improve an appearance of a cooking appliance and at the same time facilitate daily cleaning of a user.

Combined with FIG. 3, an arrowed line in FIG. 3 indicates a flow direction of soup. When the soup accidentally overflowing from a cookware flows down along the casing 1 or flows around the casing 1, the soup flowing to a position near the knob switch assembly 4 will be directed by the guide rib 6 and then flow towards a direction of an outer peripheral surface of the guide rib 6, so as to prevent the soup from flowing into the inside of the casing 1.

A tail end of the guide rib 6 is provided with a flange 61 located in an upper half circle or on a full circle thereof, and the flange 61 protrudes from an outer surface of the tail end of the guide rib 6, so that the soup overflowing from the cookware flows downward, so as to further prevent the soup from flowing into the inside of the casing 1. A height of the flange 61 is ≥1 mm, which can have a better effect of retaining water, without affecting an operation of the knob switch assembly.

As shown in FIGS. 3 and 5-7, the display screen 7 is an OLED (Organic Light-Emitting Diode) screen.

A screen display area 71 is formed in the display screen 7.

The protection assembly 8 includes a screen shield 81, and at least one heat welding column 811 is formed on a backside of the screen shield 81. An outer sidewall of the screen shield 81 is provided with a plurality of buckles 812 that are stuck in snap holes 434 in a one-to-one correspondence. The screen shield 81 is fixed to a bracket 43 of the display screen by heat welding, and a semi-transparent shield display area 813 is formed at a location of the screen shield 81 corresponding to the screen display area 71. The buckles 812 are in a shape of an arc-shaped strip, and the buckles 812 are adapted to a shape of cross sections of the snap holes 434.

The protection assembly 8 further includes a light blocking sheet 82.

The light blocking sheet 82 is disposed between the screen shield 81 and the display screen 7, and is directly adhered to or indirectly fixed to the display screen 7.

A shield transparent area 821 in an opening structure is provided on an area of the light blocking sheet 82, corresponding to the screen display area 71, and a size of the opening area is L2×H2. At least one limit hole 822 corresponding to the heat welding column 811 is disposed around the shield transparent area 821.

The sizes of the shield display area 813 and the shield transparent area 821 are slightly larger than that of the screen display area 71.

The screen shield 81 covers a surface of the display screen 7 to avoid damaging the display screen 7 by an external force. The light blocking sheet 82 is disposed between the screen shield 81 and the display screen 7 for auxiliary shading. It can be ensured that the display screen 7 does not leak light with the light blocking sheet 82 in the case that there is a deviation in the installation of the screen shield 81 and the display screen 7, and thus the display effect can be ensured.

The screen shield 81 is made of semi-transparent plastic material, which can be, but is not limited to semi-transparent ABS (Acrylonitrile Butadiene Styrene), PC (Polycarbonate), PMMA (Polymethyl methacrylate), PA (Polyamide), PP (Polypropylene), etc. The size of the screen display area 71 is L1×H1. One side of the screen shield 81 facing away from the display screen 7 is provided with a glossy surface, and the other side of the screen shield 81 facing the display screen 7 is provided with a partial-frosted and partial-glossy surface. As a result, the size of the shield transparent area 821 in the glossy surface is L2×H2.

The light blocking sheet 82 is dark, which can be, but not limited to a black, dark gray, or dark brown PET (Polyethylene Terephthalate) sheet. A backside of the light blocking sheet 82 is provided with adhesive for adhering to the screen shield 81 or the bracket 43 of the display screen.

At least one limit hole 822 is disposed on the light blocking sheet 82. Correspondingly, at least one corresponding heat welding column 811 is disposed on the screen shield 81. The light blocking sheet 82 is disposed between the screen shield 81 and the display screen 7 by the heat welding column 811 being embedded in the limit hole 822.

The screen shield 81 can also be fixed by tape or glue or can be fastened to the bracket 43 of the display screen by the buckles. The function of the screen shield 81 is to cover the surface of the display screen 7 to prevent the display screen 7 from being damaged by the external force or impact.

The screen shield 81 can also be fixed to the bracket 43 of the display screen through interference fit between the heat welding column 811 and a fixing hole of a mounting groove 431, which can prevent the screen shield 81 from falling off from the bracket 43 of the display screen. In addition, a seamless, boltless and solderless connection can be achieved, which can improve the assembly efficiency and improve the appearance after assembly.

In addition, L1+5 mm≥L2≥L1+0.5 mm, and H1+5 mm≥H2≥L2+0.5 mm.

The light blocking sheet 82 is made of a dark PET material. After assembling, the color difference between the display screen 7 and surrounding plastic pieces can be reduced. After the partial-frosted semi-transparent screen shield 81 is mounted on the surface of the display screen 7, the outline of the display screen 7 is substantially invisible from the appearance surface when the display screen 7 is not powered on. Therefore, the outline of the display screen 7 looks like being enlarged to the outline of the screen shield 81, and the size of the display screen 7 looks larger and more integral, so as to improve the appearance quality of the product and make it look more high tech.

In the power-on state, the light blocking sheet 82 can block the light of the display screen 7 from being diffused from a position outside the display area, so as to avoid affecting the visual experience of the product.

The size of the partial-glossy area of the screen shield 81 is slightly larger than that of the screen display area 71 of the display screen 7 to ensure that: even if there is a slight deviation between the screen shield 81 and the display screen 7 as installed, it can ensure that, in the power-on state, the screen display area of the display screen 7 can be completely in the light-transmitting position of the glossy area, so as to ensure the clarity of the display.

Figure 8:
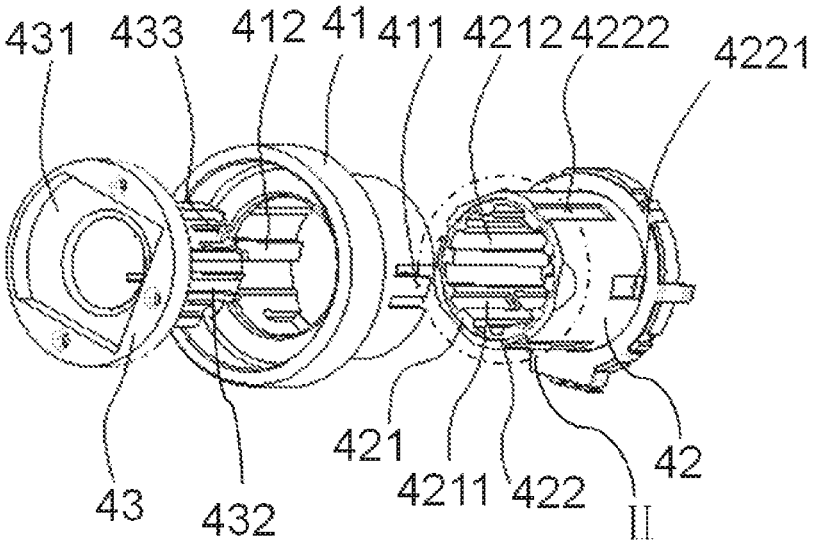
FIG. 8 is a schematic structural diagram of a knob switch assembly without a control assembly according to the present invention.

As shown in FIG. 8, the knob switch assembly 4 includes a sleeve button 41, a rotary encoder 42, and the bracket 43 of the display screen. The sleeve button 41, the rotary encoder 42 and the bracket 43 of the display screen are sequentially sleeved coaxially or approximately coaxially from outside to inside.

The sleeve button 41 is provided with a limit structure thereon for preventing a relative circumferential rotation between the sleeve button 41 and the rotary encoder 42. The limit structure includes a plurality of buckles 411 provided at one end of the sleeve button 41 adjacent to the printed circuit board 5 and a plurality of raised ribs 412 disposed on an inner wall of the sleeve button 41.

The sleeve button 41 is provided with an inner flange 413 on an inner wall of the other end of the sleeve button away from the printer circuit board 5, so as to prevent the bracket 43 of the display screen from detaching from the sleeve button.

Figure 27:
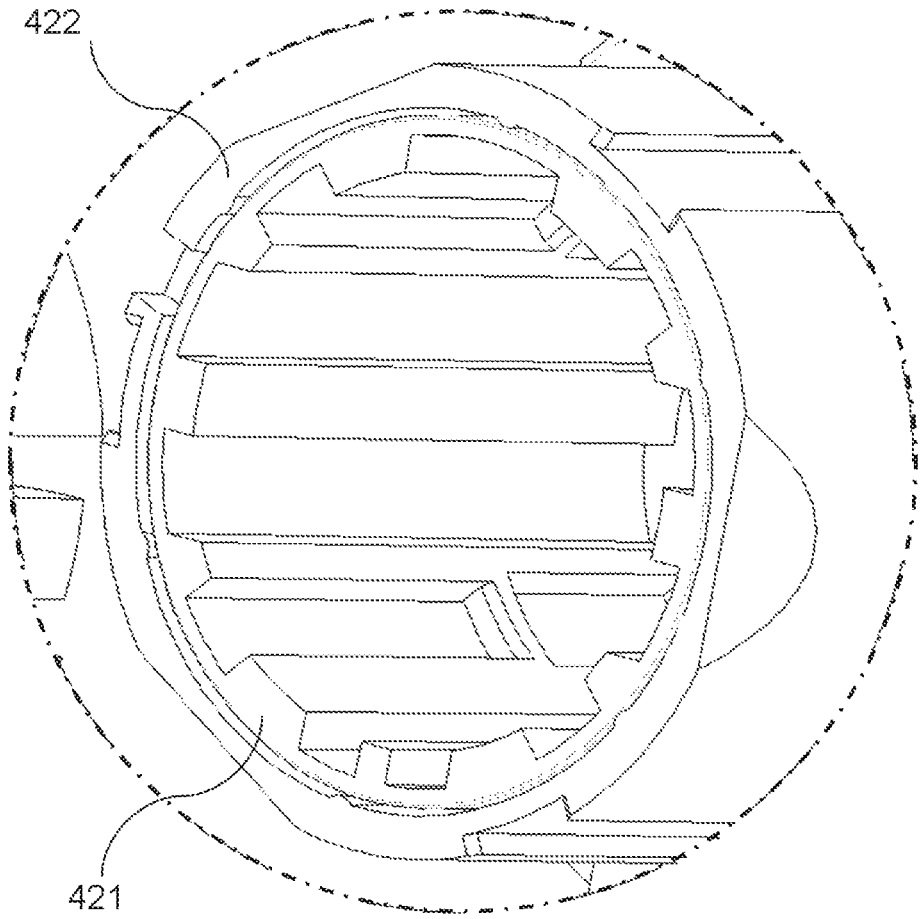
FIG. 27 is an enlarged schematic view of a portion II in FIG. 8.

As shown in FIG. 8 and FIG. 27, the rotary encoder 42 includes a fixed inner frame 421 having a hollow structure and a rotating outer frame 422. The fixed inner frame 421 and the rotating outer frame 422 are coaxially sleeved. One end of the fixed inner frame 421 is fixed to an outer side of the printed circuit board 5. The rotating outer frame 422 is free to rotate about an axis of the rotary encoder 42.

The rotary encoder 42 is provided with a limit structure thereon for preventing a relative circumferential rotation among the sleeve button 41, the rotary encoder 42 and the bracket 43 of the display screen. The limit structure includes at least one outer buckle 4221 and at least one outer keyway slot 4222 provided on an outer wall of the rotating outer frame 422, and at least one inner buckle 4211 and a limit slot 4212 provided on an inner wall of the fixed inner frame 421.

The plurality of buckles 411 are inserted in the outer buckles 4221 in a one-to-one correspondence for transmitting a rotation motion of the sleeve button 41 to the rotating outer frame 422. The raised ribs 412 are inserted into the outer keyway slots 4222 in a one-to-one correspondence to prevent the circumferential rotation between the sleeve button 41 and the rotary encoder 42.

Figure 9:
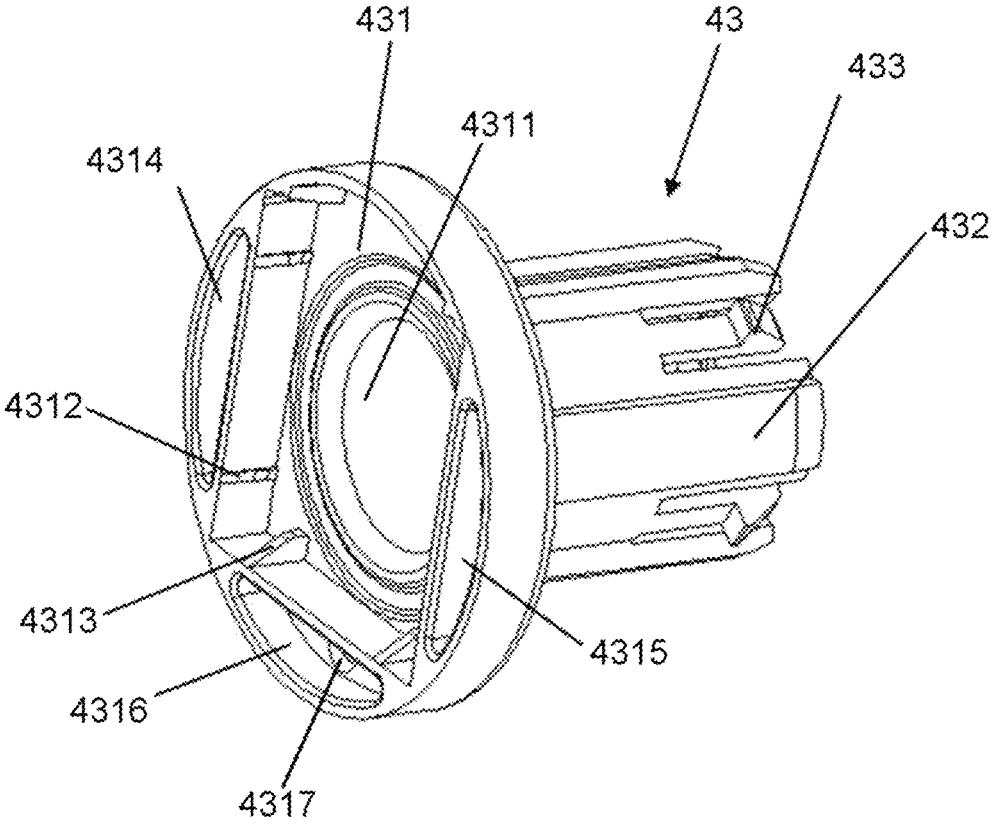
FIG. 9 is a schematic structural diagram of a bracket of a display screen according to the present invention.

As shown in FIGS. 8 and 9, a first end of the bracket 43 of the display screen is inserted into the fixed inner frame 421, and an end surface of a second end of the bracket 43 away from the printed circuit board 5 is provided with the mounting groove 431. At least one limit rib 432 and at least one limit snap 433 are disposed on an outer wall of the bracket 43 of the display screen.

The bracket 43 of the display screen is made of a dark plastic material such as black, dark gray, and dark brown.

The mounting groove 431 is configured to mount the display screen 7, so that the user can conveniently know about the current operating state of the electromagnetic oven when operating the knob assembly, without obtaining information from two separate areas.

A linear hole 4311 is formed at a bottom end of the mounting groove 431. Left and right sides of an inner wall of the mounting groove 431 are provided with symmetric catching ribs 4312, and a bottom rib 4313 is formed at a lower side of the inner wall of the mounting groove. A left mounting groove 4314 and a right mounting groove 4315 are formed respectively at left and right sides of the mounting groove 431. A lower end of the mounting groove 431 is provided with a lower mounting groove 4316. Each of the left mounting groove 4314, the right mounting groove 4315, and the lower mounting groove 4316 is provided with a fixing hole 4317 therein.

The limit rib 432 is matched with the limit slot 4212 in a one-to-one correspondence; the limit snap 433 is matched with the inner buckle 4211 in a one-to-one correspondence, so as to limit the rotation of the bracket 43 of the display screen along the axis, thereby the bracket 43 of the display screen is fixed into a position having a fixed angle in the circumferential direction.

The second end of the bracket 43 of the display screen provided with the display screen 7 is provided with at least one through hole for the heat welding column to pass through.

First Preferred Embodiment

Figure 10:
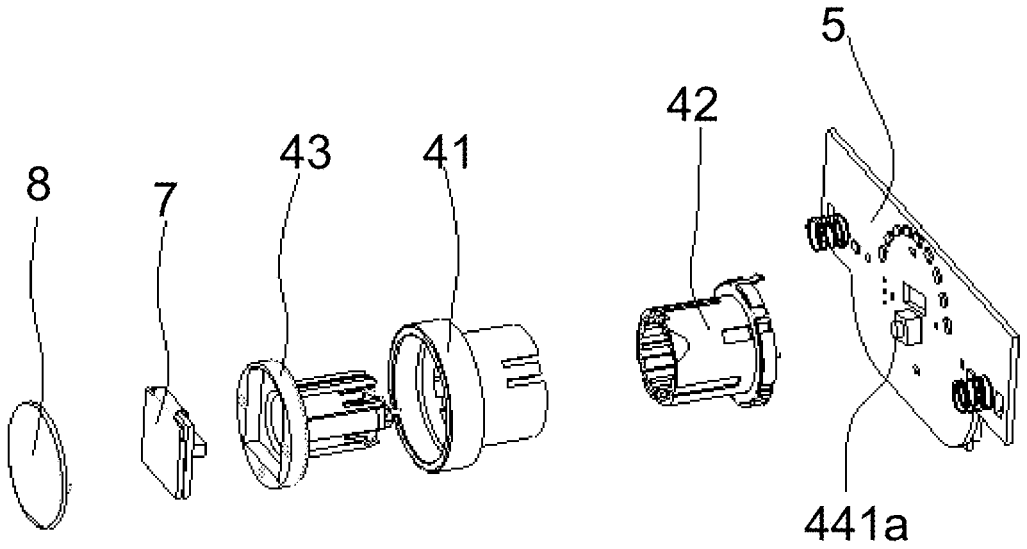
FIG. 10 is an assembly exploded diagram (perspective view) of a display screen according to a first preferred embodiment of the present invention.
Figure 11:
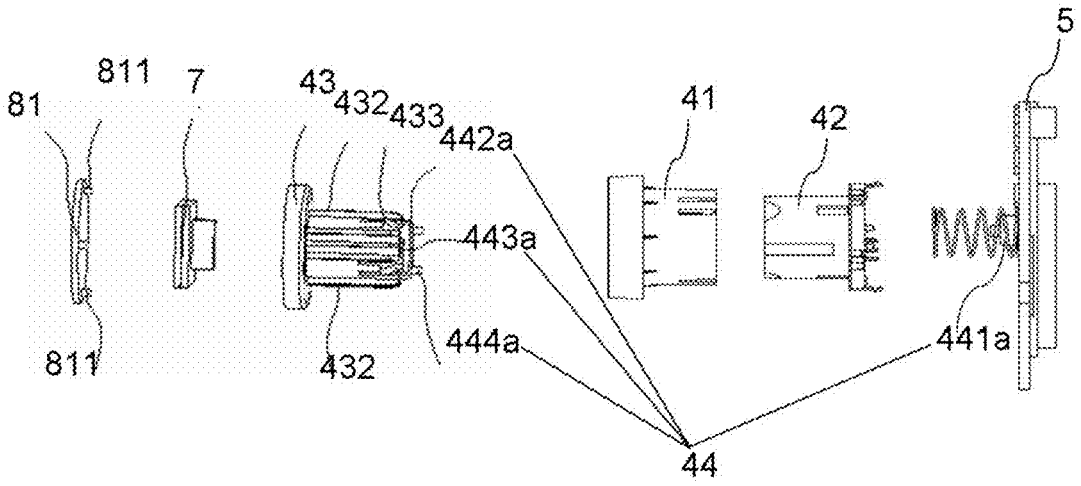
FIG. 11 is an assembly exploded diagram (front view) of the display screen according to the first preferred embodiment of the present invention.
Figure 12:
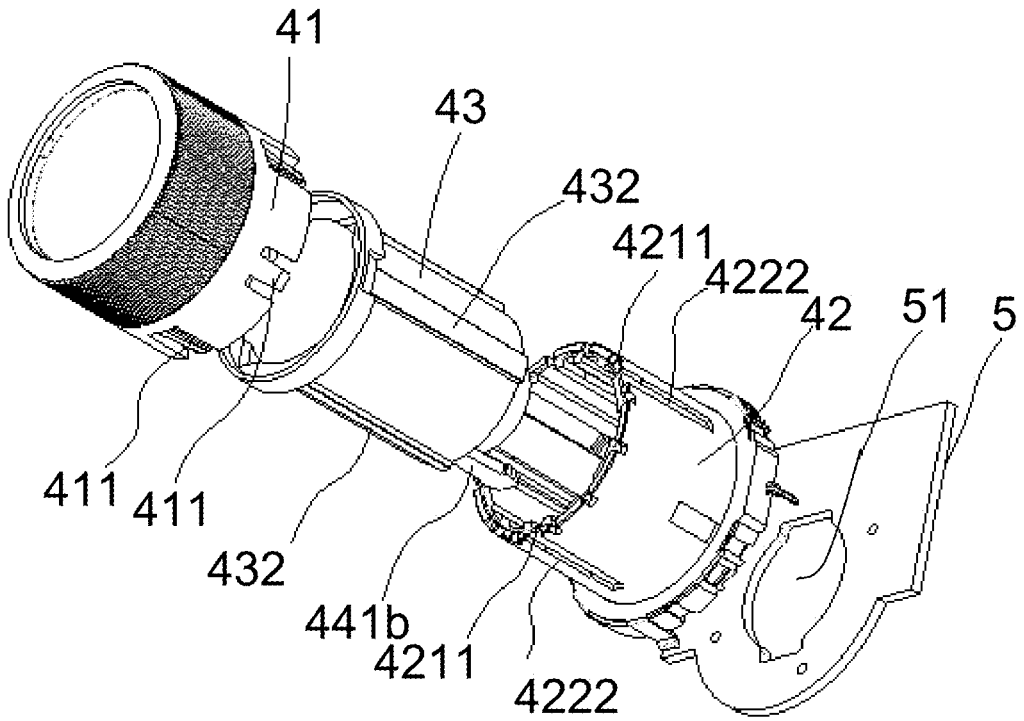
FIG. 12 is a schematic exploded diagram of a knob switch assembly according to a second preferred embodiment of the present invention.
Figure 13:
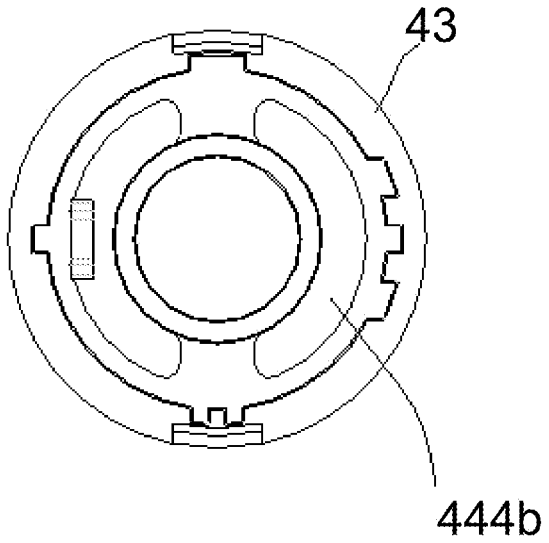
FIG. 13 is a top view of a bracket of a display screen according to the second preferred embodiment of the present invention.
Figure 14:
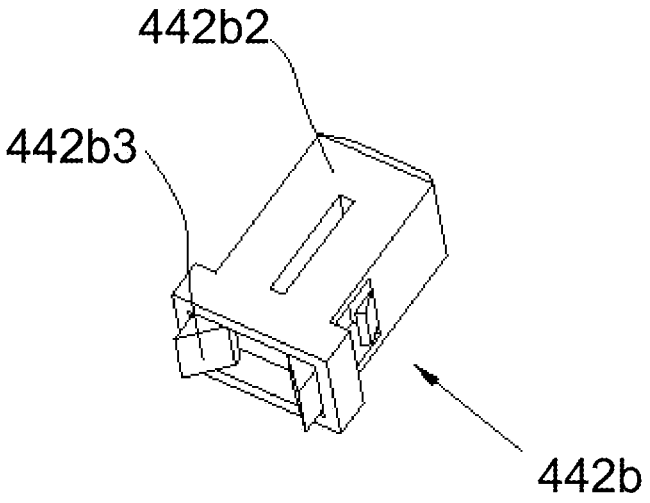
FIG. 14 is a schematic perspective view of a lock of the knob switch assembly in a locked state according to the second preferred embodiment of the present invention.
Figure 15:
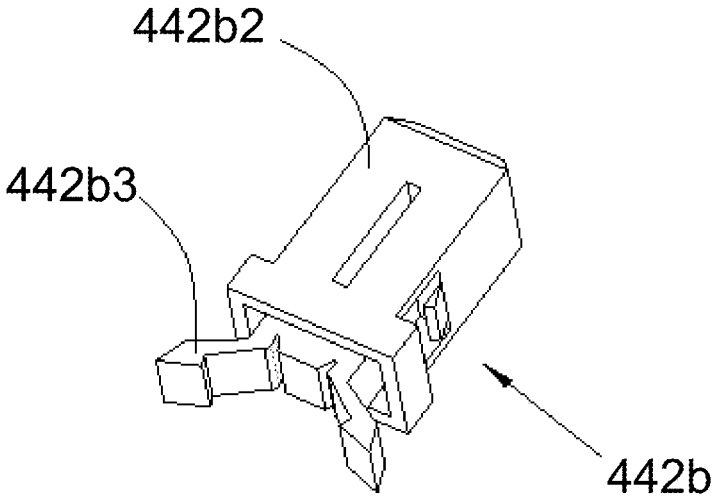
FIG. 15 is a schematic perspective view of the lock of the knob switch assembly in an unlocked state according to the second preferred embodiment of the present invention.

As shown in FIGS. 10 and 11, the control assembly 44 includes a switch button 441*a* disposed on the outer side of the printed circuit board 5, a flange piece 444*a* which is disposed on an end surface of the first end of the bracket 43 of the display screen facing the printed circuit board 5 and parallel to the end surface, and at least one elastic element 442*a* and at least one support rib 443*a* disposed at the first end of the bracket 43 of the display screen adjacent to the printed circuit board 5. The elastic element 442*a* is U-shaped, and two ends thereof are respectively connected to the bracket 43 of the display screen. The support rib 443*a* is fixed to the elastic element 442*a* and supports a surface of the printed circuit board 5.

The elastic element 442*a* is a spring or an elastic plastic rib. The elastic deformation of the elastic element 442*a* absorbs the displacement amount when the user presses the bracket 43 of the display screen, and the elastic element 442*a* rebounds to restore the bracket 43 of the display screen to the initial position when the user releases the bracket 43 of the display screen, so that the display screen 7 will not rotate together with the sleeve button 41. In this way, the display effect can be maintained at the best state where the vision of user is best, and the user experience is better.

Through pressing the bracket 43 of the display screen, a flange piece 444*a* is driven to touch the switch button 441*a*, so as to operate the electromagnetic oven.

Second Preferred Embodiment

As shown in FIGS. 12 to 20, the control assembly 44 includes a snap 441*b*, a lock 442*b* disposed within the electromagnetic oven, a return spring 443*b*, and an annular rib 444*b* formed on an inner wall of the bracket 43 of the display screen. In the second preferred embodiment, a through hole 51 is formed in the middle of the printed circuit board 5.

In the second preferred embodiment, a plurality of snap holes 434 are formed on an outer side of a wall of the mounting groove 431.

The lock 442*b* includes a mounting plate 442*b*1 and a lock body 442*b*2 connected to the mounting plate 442*b*1. The lock body 442*b*2 is provided with a Y-shaped lock catch 442*b*3 therein. The snap 441*b* which is T-shaped is fixed to an outer side wall of the bracket 43 of the display screen, and matched with the Y-shaped lock catch 442*b*3 through the through hole 51 of the printed circuit board 5. One end of the return spring 443*b* is fixed on a surface of the mounting plate 442*b*1, and the other end of the return spring is fixed to an inner side wall of the bracket 43 of the display screen and is caught by the annular rib 444*b*.

The snap 441*b* is disposed at the first end of the bracket 43 of the display screen near the lock 442*b*, so that the snap 441*b* and the lock 442*b* are fastened or disengaged by pressing the knob switch assembly 4, and the knob switch assembly 4 correspondingly retracts or extends. When the knob switch assembly 4 is in the extended state, the knob switch assembly 4 is rotated to input a control signal for adjusting the electromagnetic oven.

Figure 16:
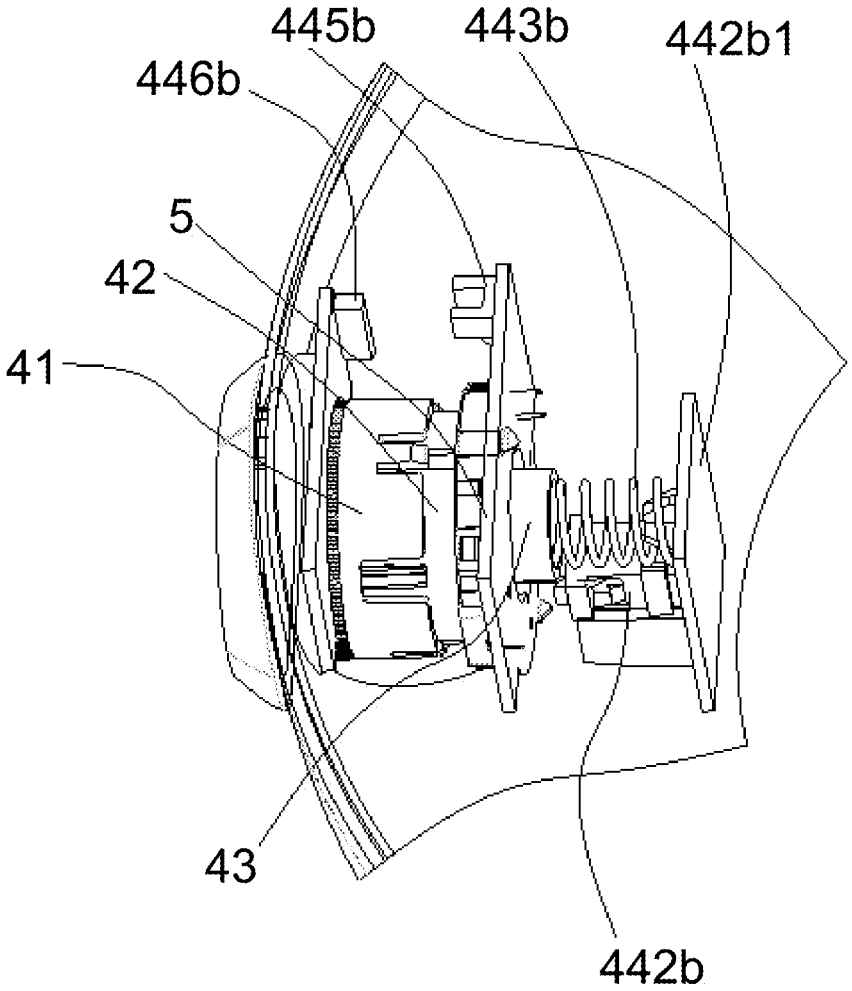
FIG. 16 is a schematic perspective view of the knob switch assembly in a retracted state according to the second preferred embodiment of the present invention.
Figure 17:
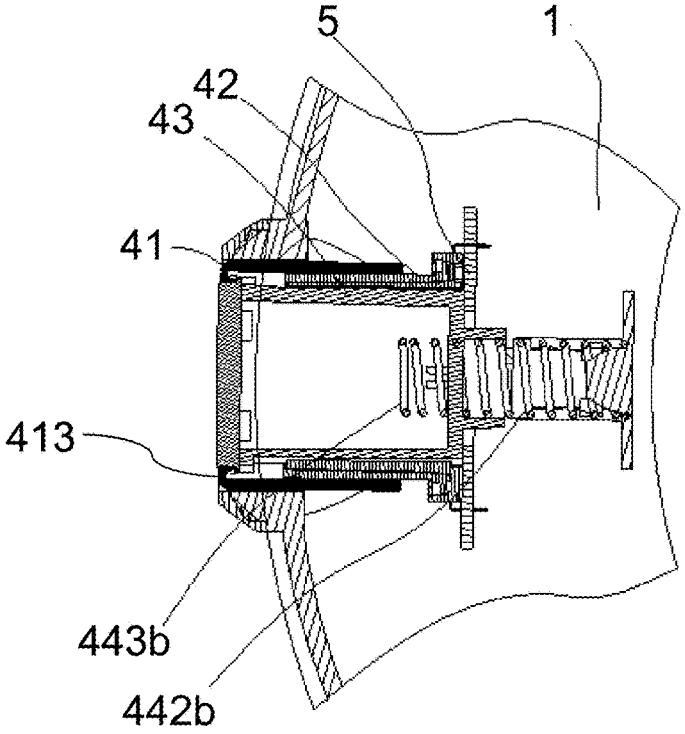
FIG. 17 is a schematic cross-sectional view of the knob switch assembly in the retracted state according to the second preferred embodiment of the present invention.
Figure 18:
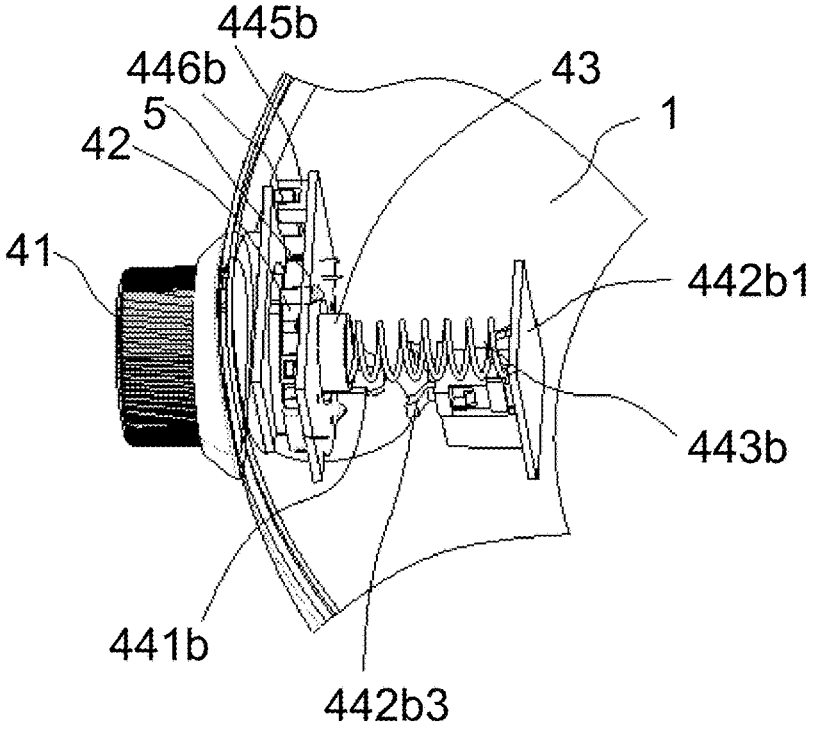
FIG. 18 is a schematic perspective view of the knob switch assembly in an extended state according to the second preferred embodiment of the present invention.
Figure 19:
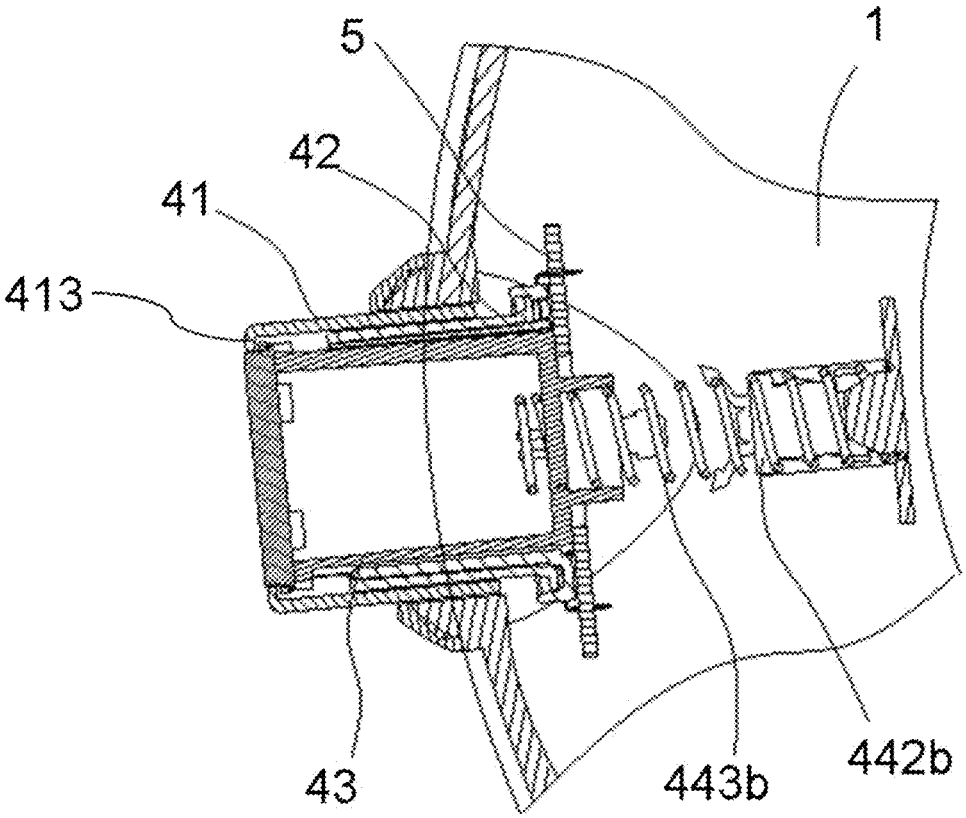
FIG. 19 is a schematic cross-sectional view of the knob switch assembly in the extended state according to the second preferred embodiment of the present invention.
Figure 20:
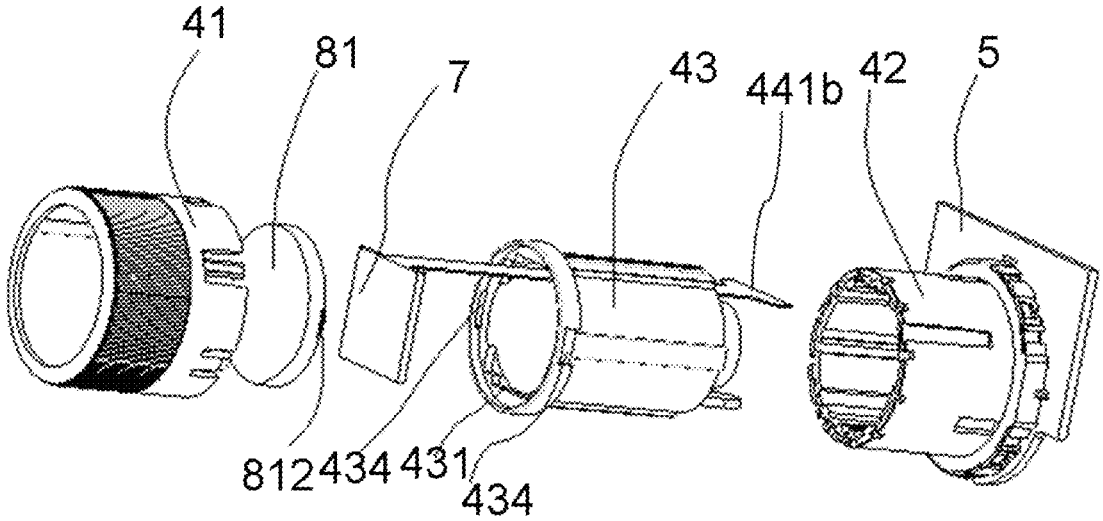
FIG. 20 is a schematic exploded diagram of the knob switch assembly provided with a display screen according to the second preferred embodiment of the present invention.

In the second preferred embodiment, the extending and retracting actions of the knob switch assembly are described as follows. The normal state of the electromagnetic oven is the retracted state of the knob switch assembly, as shown in FIGS. 16 and 17. At this time, the Y-shaped lock catch 442*b*3 of the lock 442*b* is engaged with the T-shaped snap 441*b* connected to the bracket 43 of the display screen. In this state, if the user presses the knob switch assembly, the Y-shaped lock catch 442*b*3 of the lock 442*b* becomes the unlocked state, as shown in FIGS. 18 and 19. At this time, the T-shaped snap 441*b* is no longer caught. The bracket 43 of the display screen extends outward under the action of the return spring 443*b*, thereby driving the entire knob switch assembly to extend outward. In this state, the sleeve button 41 is higher than an outer surface of the electromagnetic oven, thereby the user can operate and control the electromagnetic oven by rotating the sleeve button 41 to drive the rotary encoder 42. In this state, if the user pushes the knob switch assembly to move inward until the T-shaped snap 441*b* at the first end of the bracket 43 of the display screen touches the Y-shaped lock catch 442*b*3 of the lock 442*b*, the Y-shaped lock catch 442*b*3 is again in the engaged state. At this time, the T-shaped snap 441*b* and the Y-shaped lock catch 442*b*3 are engaged with each other again, and the knob switch assembly is in the retracted state again.

In the second preferred embodiment, the control assembly 44 further includes a signal unit. When the knob switch assembly is in the extended state under pressing, a signal receiving unit receives a signal from a signal transmitting unit, and the electromagnetic oven is adjusted through rotating the knob switch assembly.

The signal unit includes the signal transmitting unit, the signal receiving unit, and a signal shielding unit. When the knob switch assembly is in the extended state, the signal shielding unit shields the signal between the signal receiving unit and the signal transmitting unit, in order to input the control signal for adjusting the electromagnetic oven by rotating the knob switch assembly.

The signal unit is a combination of a photoelectric switch 445*b* and a light shielding sheet 446*b*, a combination of a magnetic reed switch and a magnet, or a combination of a Hall element and a magnet.

The photoelectric switch 445*b* or the light shielding sheet 446*b* is provided on the outer side of the printed circuit board 5 facing the rotary encoder 42, and the light shielding sheet 446*b* or the photoelectric switch 445*b* is disposed on the sleeve button 41.

In the second preferred embodiment, only the combination of the photoelectric switch 445*b* and the light shielding sheet 446*b* is taken as an example. A signal transmitting end serves as the signal transmitting unit, a signal receiving end serves as the signal receiving unit, and the light shielding sheet 446*b* serves as the signal shielding unit, as shown in FIGS. 16 and 18. The photoelectric switch 445*b* or the light shielding sheet 446*b* is disposed on a board surface of the printed circuit board 5 close to the rotary encoder 42, and the light shielding sheet 446*b* (or the photoelectric switch) is disposed on the knob switch assembly 4 (in the second preferred embodiment, disposed on the sleeve button 41) or the electromagnetic oven. The characteristic of the photoelectric switch 445*b* is that: the voltage level of the signal transmitting end is switched between a low level and a high level in the state that there is no light shielding between the signal transmitting end and the signal receiving end. When the rotary encoder 32 is in the retracted state, the photoelectric switch 445*b* is far away from the light shielding sheet 446*b*. Combined with FIG. 16, there is no barrier between the signal receiving end and the signal transmitting end of the photoelectric switch 445*b*. In this state, the state of the electromagnetic oven is set to a standby state, and even though the knob switch assembly 4 is rotated at this time, the electromagnetic oven will not receive the signal. When the rotary encoder 32 is in the extended state, combined with FIG. 18, the light shielding sheet 446*b* is inserted into a notch of the photoelectric switch 445*b*. In this state, the state of the electromagnetic oven is set to the operating state. At this time, when the knob switch assembly is rotated, the electromagnetic oven can perform related operations such as adjusting the power or adjusting the time according to the rotational position of the rotary encoder 42.

The OLED screen is of a dot matrix type, and can display different information by the MCU outputting different driving signals, which is more flexible than the conventional digital tube display. In addition, the OLED screen 7 occupies a smaller area, thereby saving space.

Figure 21:
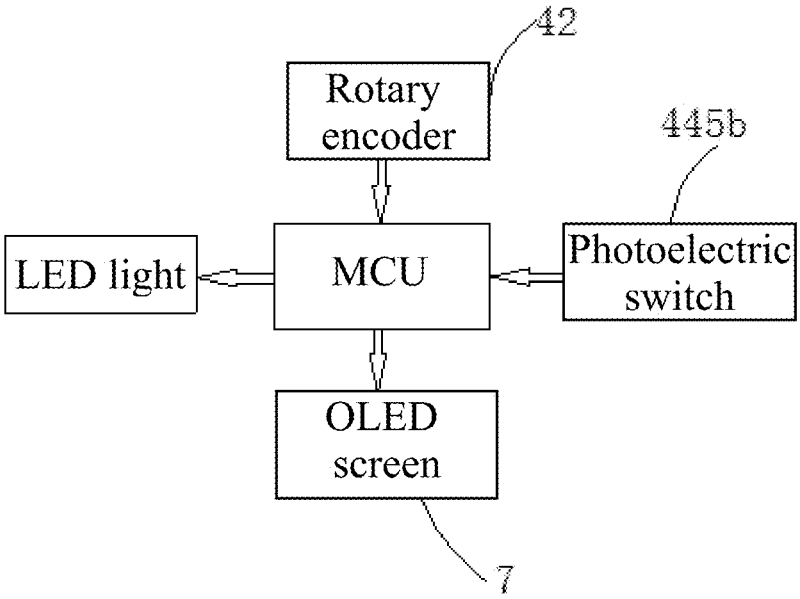
FIG. 21 is a main control block diagram of an MCU (Microcontroller Unit) of the knob switch assembly according to the second preferred embodiment of the present invention.

As shown in FIG. 21, the MCU integrated on the printed circuit board 5 is respectively connected to the photoelectric switch 445*b*, the rotary encoder 42, the OLED screen 7, and an LED light in terms of signal. Through pressing the knob switch assembly 4 passing through the through hole 11 of the casing 1, the lock 442*b* is engaged with or disengaged from the lock catch 442*b*3, the knob switch assembly 4 is correspondingly in the retracted or extended state, and the power and time of the electromagnetic oven can be adjusted through rotating the knob switch assembly 4 in the extended state.

The operating method of the electromagnetic oven of the present invention is as follows, and the rotary encoder 42 of Shengwei electronic hollow incremental type EC350202 is taken as an example.

1) When the electromagnetic oven is powered on, the rotary encoder 42 of the knob switch assembly 4 is in the retracted state, there is no barrier between the signal receiving end and the signal transmitting end of the photoelectric switch 445*b*, and the photoelectric switch outputs a high level at this time. The signal output by the photoelectric switch is processed by the MCU, and the MCU drives the LED lights to flash to inform the user that the electromagnetic oven is in the standby state. At the same time, the built-in timer of the MCU starts to count t1. When t≥t1 (30s≤t1≤90s), the MCU drives the LED lights to be off to reduce the power consumption of the electromagnetic oven for the standby state. In the standby state, if rotating the sleeve button 41, the rotary encoder 42 will rotate together with the sleeve button 41; the MCU does not receive any signal, and the MCU drives the IGBT (Insulated Gate Bipolar Transistor) module to place the coil disk in the turned off state.

2) When the rotary encoder 42 is in the extended state (namely the knob switch assembly 4 is in the extended state) after the user presses the sleeve button 41, the notch of the photoelectric switch 445*b* is blocked by the light shielding sheet 446*b*, and a space between the signal receiving end and the signal transmitted end of the photoelectric switch 445*b* is blocked by the light shielding sheet 446*b*. At this time, the photoelectric switch 445*b* outputs a low level. At this time, when the rotary encoder 42 is rotated by rotating the sleeve button 41, the pulse signal outputted by the rotary encoder 42 is processed by the MCU, and the MCU drives the LED lights to be constantly on to remind the user that the electromagnetic oven is in the operating state. When the electromagnetic oven is in the operating state, the control signal for adjusting the electromagnetic oven can be inputted by rotating the knob switch assembly, and the specific process is described as follows.

A. If the sleeve button 41 is rotated clockwise, the MCU drives the IGBT module to control the power of the coil disk to gradually increase, until reaching the maximum power set for the coil disk, and the number of LED lights lighted up is gradually increased (or the brightness is gradually increased) until all of the LED lights are lighted up (the number of LED lights in the second preferred embodiment is 9). If the sleeve button 41 is rotated counterclockwise, the MCU drives the IGBT module to control the power of the coil disk to gradually reduce until the coil disk is turned off and the power is zero, and the number of LED lights lighted up is gradually decreased (or the brightness is gradually weakened) until only one of the LED lights is lighted up.

B. When the user presses the sleeve button 41 to bring the rotary encoder 42 into the retracted state (namely the knob switch assembly 4 is in the retracted state), the photoelectric switch 445*b* is far away from the light shielding sheet 446*b* again, there is no barrier between the signal receiving end and the signal transmitting end of the photoelectric switch 445*b*. At this time, the photoelectric switch 445*b* outputs a high level. At the same time, the built-in timer of the MCU starts counting t2. When t≤t2 (in the second preferred embodiment, 10s≤t2≤40s), if the MCU detects the pulse outputted by the rotary encoder 42, the MCU processes the pulse signal to adjust the set operation time of the electromagnetic oven. When t≤t2, if the sleeve button 41 is rotated clockwise, the time displayed by the OLED screen is driven by the MCU to increase, and the heating time set in default is extended; if the sleeve button 41 is rotated counterclockwise, the time displayed by the OLED screen is driven by the MCU to decrease, and the heating time set in default is shortened. When t>t2, if the MCU does not detect the pulse outputted by the rotary encoder 42, the MCU determines that the electromagnetic oven is in the standby state. In this state, the LED light flashes to inform the user that the electromagnetic oven is in the standby state. In the standby state, the built-in timer of the MCU restarts counting t1, when t≥t1 (30s≤t1≤90s), the MCU drives the LED light to be off, thereby reducing the power consumption of the product in the standby state. In this state, if the sleeve button 41 is rotated, the rotary encoder 42 will not rotate together; the MCU does not receive any signal, and the MCU drives the IGBT module to place the coil disk in the turned off state.

Figure 22:
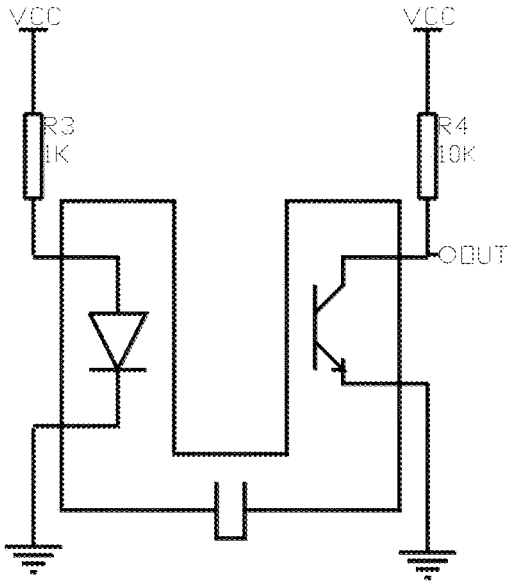
FIG. 22 is a circuit diagram of a photoelectric switch of the knob switch assembly according to the second preferred embodiment of the present invention.
Figure 23:
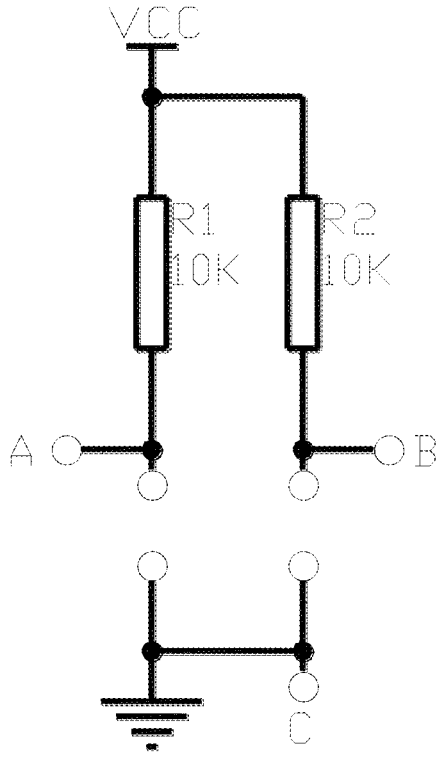
FIG. 23 is a circuit diagram of a rotary encoder and the photoelectric switch of the knob switch assembly when rotating according to the second preferred embodiment of the present invention.
Figure 24:
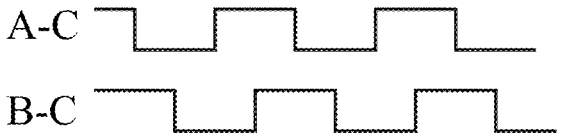
FIG. 24 is a waveform diagram when the rotary encoder and the photoelectric switch of the knob switch assembly rotate clockwise according to the second preferred embodiment of the present invention.
Figure 25:
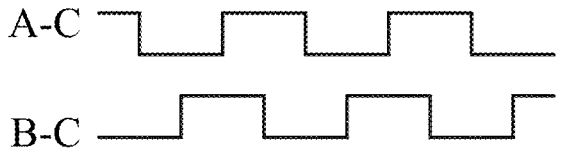
FIG. 25 is a waveform diagram when the rotary encoder and the photoelectric switch of the knob switch assembly rotate counterclockwise according to the second preferred embodiment of the present invention.
Figure 26:
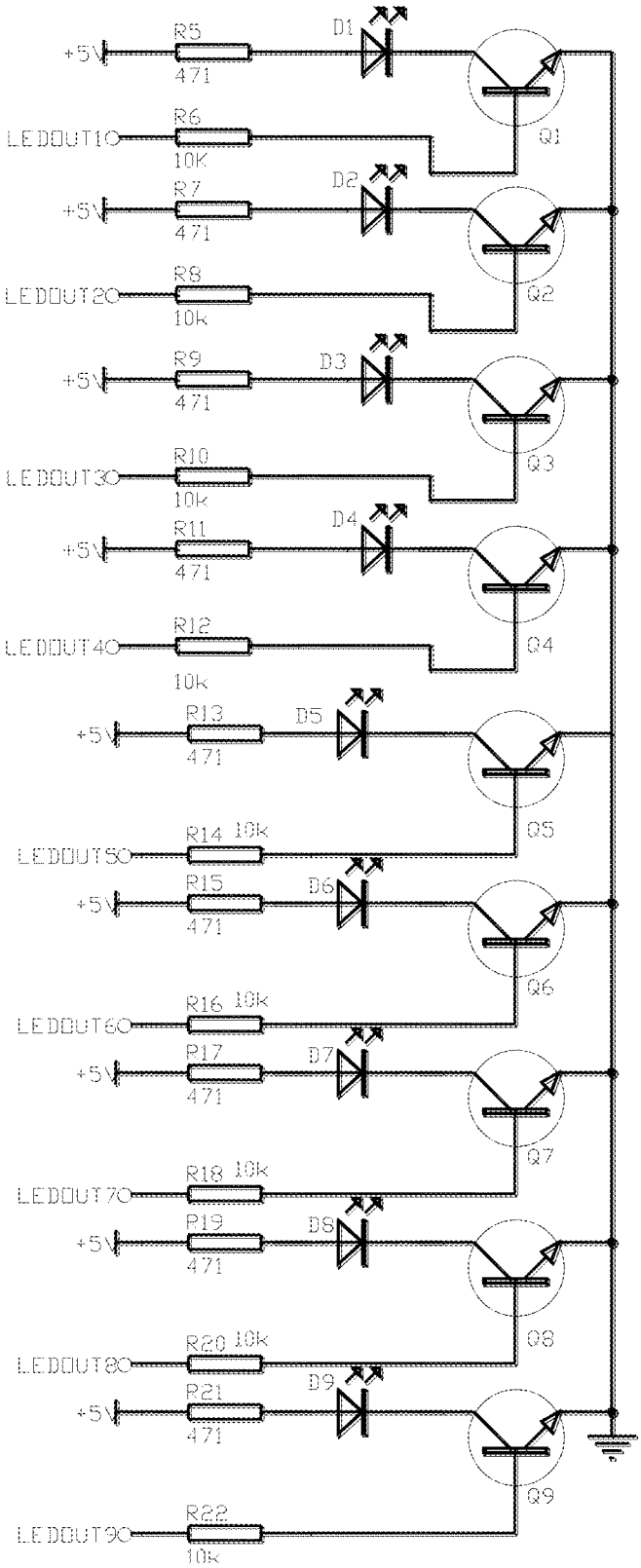
FIG. 26 shows a driving circuit for firepower indication of LED (Light-Emitting Diode) lights of the electromagnetic oven according to the second preferred embodiment of the present invention.

In the second preferred embodiment, the MCU determines whether the knob switch assembly is in a retracted state or an extended state by detecting whether there is a barrier at the notch of the photoelectric switch 445*b*. As shown in FIG. 22, the MCU determines whether the knob switch assembly is in a retracted state or an extended state by detecting the voltage level of an OUT end of the notch type photoelectric switch 445*b*. That is to say, when there is a barrier at the notch, the light is isolated, and the OUT end outputs a high level; when the barrier is removed from the notch, the light can pass, and the OUT end outputs a low level. The MCU determines whether the knob switch assembly is rotated clockwise or counterclockwise by the rotary encoder 42. As shown in FIGS. 23 to 25, when the rotary encoder 42 and the photoelectric switch 445*b* rotate together, the MCU determines whether the knob switch assembly is rotated clockwise or counterclockwise by detecting the waveform changes of the point A and the point B of the rotary encoder 42, thereby adjusting the level of the firepower or the length of time. The level of the firepower is represented by the LED lights. On the display screen 7, the firepower is represented by the flame shape, and the time is displayed in numbers. A driving circuit for firepower indication of the LED lights is shown in FIG. 26. In order to ensure the brightness of the LED lights, each of the LED lights is driven by one NPN transistor. The MCU assigns an IO driver to each of the LED lights. When the IO driver outputs a high level, the LED light is lighted up. When the IO driver outputs a low level, the LED light is off. Therefore, the number of LED lights lighted up and the brightness of the LED lights lighted up can be flexibly controlled.

The above embodiments are only exemplary embodiments of the present invention, and are not intended to limit the present invention. The scope of the present invention is defined by the claims. Those skilled in the art can make various modifications or equivalents to the present invention within the spirit and scope of the present invention. Such modifications or equivalents are also considered to be within the protection scope of the present invention.

In the present invention, the knob switch assembly is provided as a telescopic structure and is provided with the signal unit therein. In operation, once pressed, the knob switch assembly will automatically pop up, and the user can adjust the power and the heating time of the electromagnetic oven through the knob switch assembly. After operation, the knob switch assembly will be retracted to the inside of the electromagnetic oven when it is pressed. It can prolong the service life of the electromagnetic oven and facilitate the cleaning by the user.

The present invention integrates three kinds of signal receiving devices and signal feedback devices, respectively the display screen, the rotary encoder and the control assembly, into the knob switch assembly, thereby effectively saving the space of the electromagnetic oven occupied by the operation display interface, miniaturizing the product and lowering the cost.

The present invention adopts a guide rib around the knob switch assembly of the casing, so that when the soup overflowing accidentally from the casing flows downward or along the casing, the soup flowing to a position near the knob switch assembly will be guided by the guide rib and then flow towards the direction of the outer peripheral surface of the guide rib, so as to prevent the soup from flowing into the inside of the casing.

The present invention realizes fixing of the display screen by the mounting groove on the bracket of the display screen, realizes the protection of the display screen by the screen shield and the light blocking sheet, and ensures the display effect of the OLED screen. The present invention can ensure that the display is clear by arranging the display area of the protection assembly to be slightly larger than that of the display screen. The present invention realizes the fixing of the protection assembly and the bracket of the display screen by the heat welding column and the snap hole, and can ensure the stability of the protection assembly.

What is claimed is:

1. A knob structure for an electromagnetic oven, comprising at least one knob switch assembly (4) disposed on a casing (1) and a printed circuit board (5) disposed in the casing (1), wherein: the knob switch assembly (4) is connected to the printed circuit board (5) through a through hole (11) provided on the casing (1);

a guide rib (6) protruding from the casing (1) is disposed around a circumference of the through hole (11);

a display screen (7) is equipped on the knob switch assembly (4);

the knob switch assembly (4) comprises a sleeve button (41), a rotary encoder (42), a bracket (43) of the display screen, and a control assembly (44); and a protection assembly (8) is provided outside the display screen (7); the protection assembly (8) comprises a screen shield (81): a heat welding column (811) is formed at a backside of the screen shield (81); an outer side wall of the screen shield (81) is provided with a plurality of buckles (812) that are snapped to snap holes (434) in a one-to-one correspondence; the screen shield (81) is fixed to the bracket (43) of the display screen by heat welding, and a semi-transparent shield display area (813) is formed at an area of the screen shield corresponding to the display screen (7).

2. The knob structure for the electromagnetic oven, as recited in claim 1, wherein: the sleeve button (41), the rotary encoder (42) and the bracket (43) of the display screen are sequentially assembled along an axis from outside to inside.

3. The knob structure for the electromagnetic oven, as recited in claim 1, wherein: the sleeve button (41) is provided with a limit structure thereon for preventing a relative circumferential rotation between the sleeve button (41) and the rotary encoder; the limit structure comprises a plurality of buckles (411) disposed at a first end of the sleeve button (41), adjacent to the printed circuit board (5), and a plurality of raised ribs (412) disposed on an inner wall of the sleeve button (41).

4. The knob structure for the electromagnetic oven, as recited in claim 1, wherein: an inner flange (413) is provided on an inner wall of a second end of the sleeve button (41), and the second end of the sleeve button is away from the printed circuit board (5).

5. The knob structure for the electromagnetic oven, as recited in claim 1, wherein: the control assembly (44) comprises a switch button (441*a*) disposed on an outer side of the printed circuit board (5), a flange piece (444*a*) which is disposed on and parallel to an end surface of a first end of the bracket (43) of the display screen facing the printed circuit board (5), and at least one elastic element (442*a*) and at least one support rib (443*a*) disposed on the first end of the bracket (43) of the display screen adjacent to the printed circuit board (5); both ends of the elastic element (442*a*) are respectively connected to the bracket (43) of the display screen; and the support rib (443*a*) is fixed to the elastic element (442*a*), and supports a surface of the printed circuit board (5).

6. The knob structure for the electromagnetic oven, as recited in claim 1, wherein: the control assembly (44) comprises a snap (441*b*), a lock (442*b*) provided within the electromagnetic oven, a return spring (443*b*), and an annular rib (444*b*) formed on an inner wall of the bracket (43) of the display screen; the lock (442*b*) comprises a mounting plate (442*b*1) and a lock body (442*b*2) connected to the mounting plate (442*b*1); the lock body (442*b*2) is provided with a lock catch therein (442*b*3); the snap (441*b*) is fixed on an outer side wall of the bracket (43) of the display screen and matched with the lock catch (442*b*3) through the through hole of the printed circuit board (5); one end of the return spring (443*b*) is fixed to a surface of the mounting plate (442*b*1), and the other end of the return spring is fixed to an inner side wall of the bracket (43) of the display screen and is caught by the annular rib (444*b*).

7. The knob structure for the electromagnetic oven, as recited in claim 1, wherein: an outer surface of the guide rib (6) is a concave curved surface, and an inner diameter of the guide rib (6) is gradually reduced from inside to outside.

8. The knob structure for the electromagnetic oven, as recited in claim 1, wherein the display screen (7) is an OLED (Organic Light-Emitting Diode) screen.

9. The knob structure for the electromagnetic oven, as recited in claim 1, wherein a screen display area (71) is formed in the display screen (7).

10. The knob structure for the electromagnetic oven, as recited in claim 1, wherein: a front surface of the screen shield (81) forms a glossy surface, and a back surface of the screen shield forms a partial-frosted and partial-glossy surface.

11. The knob structure for the electromagnetic oven, as recited in claim 1, wherein: the rotary encoder (42) comprises a fixed inner frame (421) and a rotating outer frame (422) having a hollow structure: the fixed inner frame (421) is coaxially sleeved with the rotating outer frame (422), and one end of the fixed inner frame (421) is fixed to an outer side of the printed circuit board (5).

12. The knob structure for the electromagnetic oven, as recited in claim 11, wherein: at least one outer buckle (4221) and at least one outer keyway slot (4222) are provided on an outer wall of the rotating outer frame (422), and at least one inner buckle (4211) and one limit slot (4212) are provided on an inner wall of the fixed inner frame (421).

13. The knob structure for the electromagnetic oven, as recited in claim 1, wherein: a first end of the bracket (43) of the display screen is inserted into a fixed inner frame (421); an end surface of a second end of the bracket (43) of the display screen, away from the printed circuit board (5), is provided with a mounting groove (431); and an outer wall of the bracket (43) of the display screen is provided with at least one limit rib (432) and at least one limit snap (433).

14. The knob structure for the electromagnetic oven, as recited in claim 13, wherein: a plurality of snap holes (434) are formed on an outer side of a groove wall of the mounting groove (431); a linear hole (4311) is provided at a bottom end of the mounting groove (431); a set of catching ribs (4312) are provided on an inner wall of the mounting groove symmetrically, and a bottom rib (4313) is formed at a lower side of the inner wall of the mounting groove; a left mounting groove (4314) and a right mounting groove (4315) are respectively formed at left and right sides of the mounting groove (431); and a fixing hole is formed in each of the left mounting groove (4314) and the right mounting groove (4315).

15. The knob structure for the electromagnetic oven, as recited in claim 1, wherein: a tail end of the guide rib (6) is provided with a flange (61) on an upper half or full circle thereof, and the flange (61) protrudes from an outer surface of the tail end of the guide rib (6).

16. The knob structure for the electromagnetic oven, as recited in claim 15, wherein a height of the flange (61) is greater than or equal to 1 mm.

17. The knob structure for the electromagnetic oven, as recited in claim 1, wherein the protection assembly (8) further comprises a light blocking sheet (82).

18. The knob structure for the electromagnetic oven, as recited in claim 17, wherein: the light blocking sheet (82) is disposed between the screen shield (81) and the display screen (7), and is directly adhered to or indirectly fixed to the display screen (7).

19. The knob structure for the electromagnetic oven, as recited in claim 18, wherein: a shield transparent area (821) of an opening structure, corresponding to a screen display area (71), is formed on the light blocking sheet (82), and at least one limit hole (822) corresponding to the heat welding column (811) is disposed around the shield transparent area (821).

* * * * *